US005803742A

United States Patent [19]

Buti

[11] Patent Number: 5,803,742

[45] Date of Patent: Sep. 8, 1998

[54] LANGUAGE GAME

[76] Inventor: Amekossou J. Buti, 16840 Telegraph Rd. #47, Detroit, Mich. 48219

[21] Appl. No.: 990,238

[22] Filed: Dec. 15, 1997

[51] Int. Cl.[6] ..... A63F 1/00

[52] U.S. Cl. ..... 434/157; 434/128; 434/172; 273/299; 273/308

[58] Field of Search ..... 273/292, 296, 273/299, 308; 434/128, 157, 172

[56] References Cited

U.S. PATENT DOCUMENTS

| | | | |
|---|---|---|---|
| 196,532 | 10/1877 | Martin | 434/172 |
| 1,591,639 | 7/1926 | McDonald | 434/172 X |
| 2,000,812 | 5/1935 | Adams | 273/299 |
| 4,826,175 | 5/1989 | Quatrino | 273/299 |
| 5,275,818 | 1/1994 | Kind | 434/157 |
| 5,374,065 | 12/1994 | Motskin | 273/299 X |

FOREIGN PATENT DOCUMENTS

| | | | |
|---|---|---|---|
| 521784 | 7/1921 | France | 434/157 |
| 1911953 | 9/1970 | Germany | 434/172 |

*Primary Examiner*—John A. Ricci

[57] ABSTRACT

A language game is provided including a game board having a front face, a rear face and a square configuration. The front face has a matrix of a first number of squares each having a first surface area. A set of blocks each have a thin square configuration with a pair of faces each having the first surface area. The set of blocks includes a first subset of blocks each having a written word of a foreign language representative of a unique object thereon. A second subset of blocks each have a pictorial representation of one of the objects thereon.

5 Claims, 2 Drawing Sheets

FIG. 3
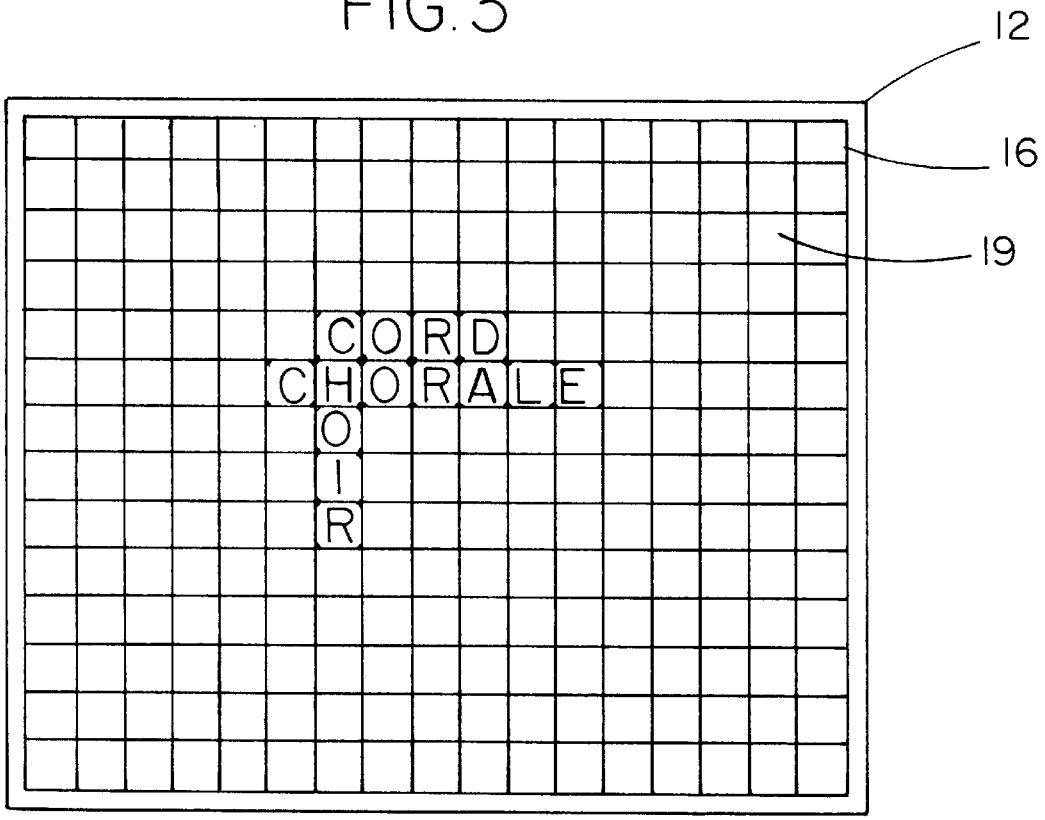
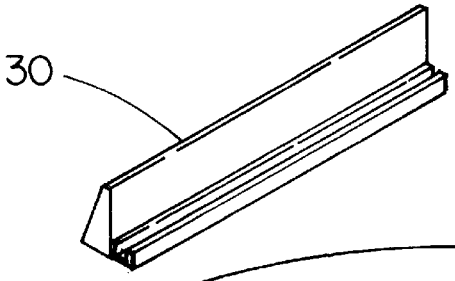
FIG. 4
FIG. 5
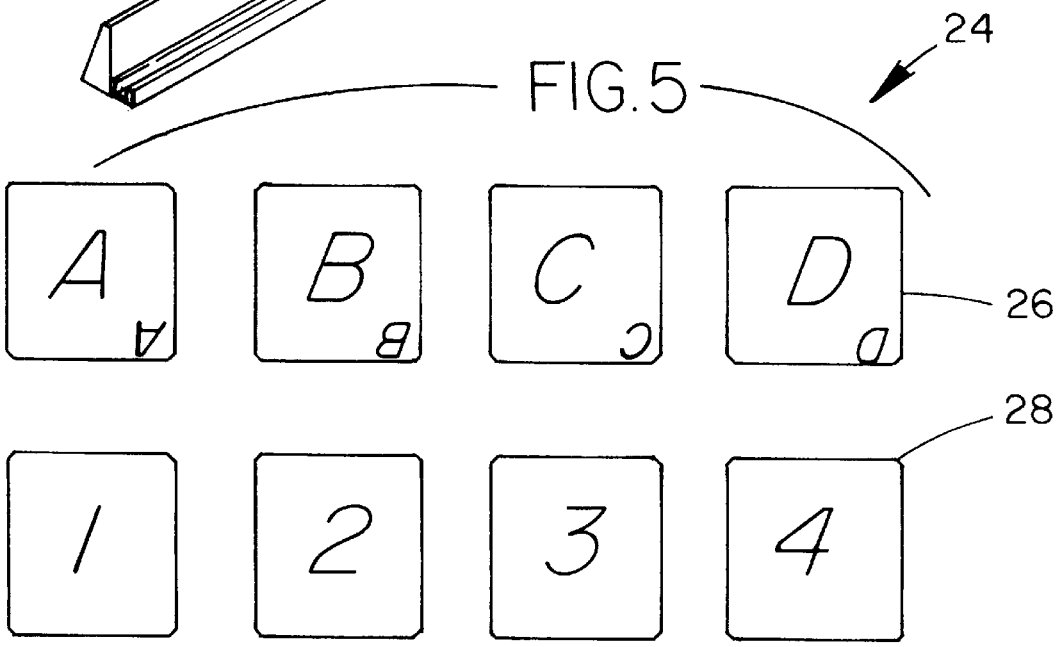

LANGUAGE GAME

BACKGROUND OF THE INVENTION

1. Field of the Invention

The present invention relates to a language game and more particularly pertains to teaching foreign languages.

2. Description of the Prior Art

The use of board games is known in the prior art. More specifically, board games heretofore devised and utilized for the purpose of entertainment purposes are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,374,065; U.S. Pat. No. 4,625,971; U.S. Pat. No. 4,336,020; U.S. Pat. No. 3,888,025; U.S. Pat. No. 4,896,889; and U.S. Pat. No. Des. 351,003.

In this respect, the language game according to the present invention substantially departs from the conventional concepts and designs of the prior art, and in so doing provides an apparatus primarily developed for the purpose of teaching foreign languages.

Therefore, it can be appreciated that there exists a continuing need for a new and improved language game which can be used for teaching foreign languages. In this regard, the present invention substantially fulfills this need.

SUMMARY OF THE INVENTION

In view of the foregoing disadvantages inherent in the known types of board games now present in the prior art, the present invention provides an improved language game. As such, the general purpose of the present invention, which will be described subsequently in greater detail, is to provide a new and improved language game which has all the advantages of the prior art and none of the disadvantages.

To attain this, the present invention essentially comprises a planar rigid game board having a front face, a rear face and a square configuration. The front face has a matrix of a first number of squares each having a first surface area. Note FIG. 1. The rear face has a matrix of a second number of squares greater than the first number. Further, the squares of the rear face of the game board each have a second surface area less than the first surface area. See FIG. 3. Next provided is a first set of blocks each having a thin square configuration with a pair of faces each having the first surface area. The first set of blocks includes a first subset of blocks having a written word of a foreign language representative of a unique object thereon. Associated therewith is a second subset of blocks having a pictorial representation of one of the objects, as shown in FIG. 2. FIG. 5 shows a second set of blocks each having a thin square configuration with a pair of faces each having the second surface area. The second set of blocks each has a first side face having a letter printed thereon. A second side face has a number printed thereon representative of a score value of the letter associated therewith. For reasons that will soon become apparent, each block of the second set of blocks has one of two colors.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved language game which has all the advantages of the prior art board games and none of the disadvantages.

It is another object of the present invention to provide a new and improved language game which may be easily and efficiently manufactured and marketed.

It is a further object of the present invention to provide a new and improved language game which is of a durable and reliable construction.

An even further object of the present invention is to provide a new and improved language game which is susceptible of a low cost of manufacture with regard to both materials and labor, and which accordingly is then susceptible of low prices of sale to the consuming public, thereby making such language game economically available to the buying public.

Still yet another object of the present invention is to provide a new and improved language game which provides in the apparatuses and methods of the prior art some of the advantages thereof, while simultaneously overcoming some of the disadvantages normally associated therewith.

Still another object of the present invention is to teach foreign languages.

Lastly, it is an object of the present invention to provide a new and improved language game that includes a game board having a front face, a rear face and a square configuration. The front face has a matrix of a first number of squares each having a first surface area. A set of blocks each have a thin square configuration with a pair of faces each having the first surface area. The set of blocks includes a first subset of blocks each having a written word of a foreign language representative of a unique object thereon. A second subset of blocks each have a pictorial representation of one of the objects thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a plan view of the rear face of the present invention.

FIG. 4 is a perspective view of the stand of the present invention.

FIG. 5 is a top view of the second set of blocks of the present invention.

Similar reference characters refer to similar parts throughout the several views of the drawings.

DESCRIPTION OF THE PREFERRED EMBODIMENT

Figure 1:
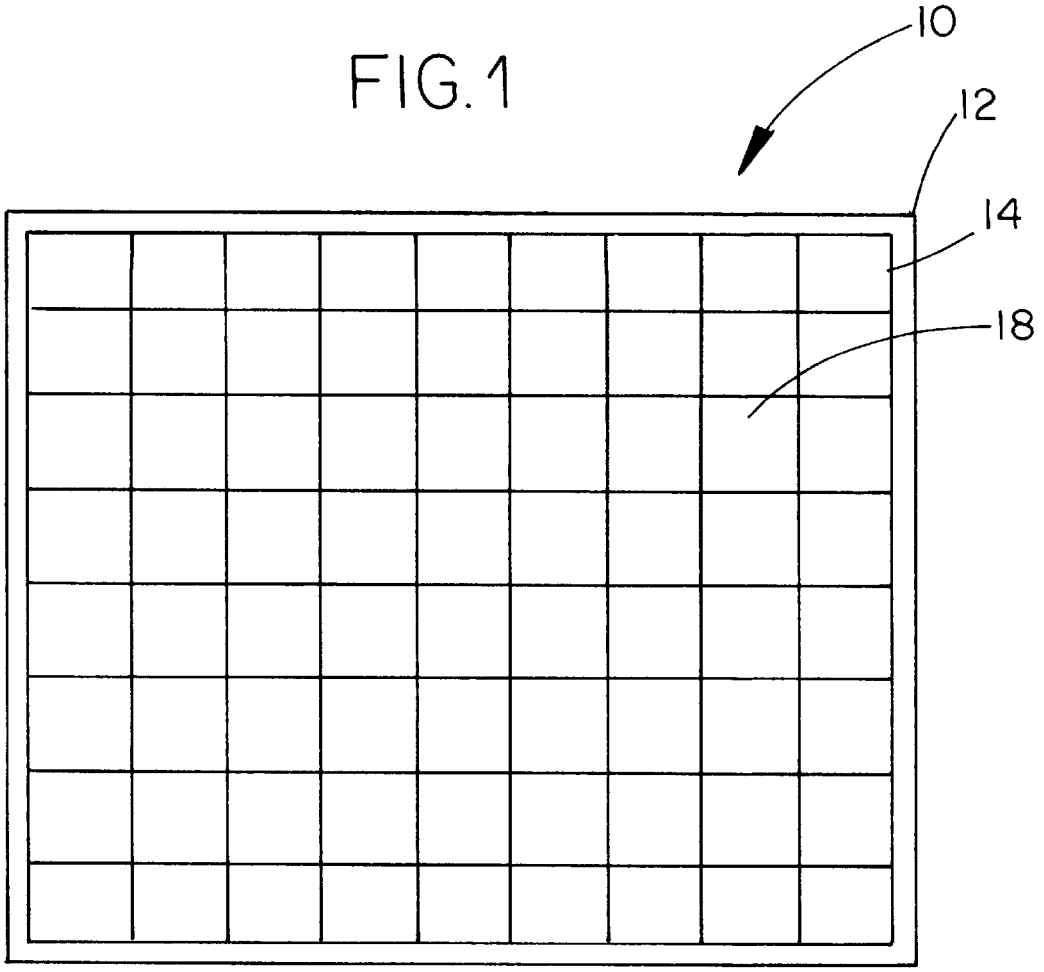
FIG. 1 is an illustration of the preferred embodiment of the language game constructed in accordance with the principles of the present invention.

With reference now to the drawings, and in particular to FIG. 1 thereof, a new and improved language game embodying the principles and concepts of the present invention and generally designated by the reference numeral 10 will be described.

The present invention, the new and improved language game, is comprised of a plurality of components. Such components in their broadest context include game board and a plurality of blocks. Such components are individually configured and correlated with respect to each other so as to attain the desired objective.

The present invention, designated as numeral 10, includes a planar rigid game board 12 having a front face 14, a rear face 16 and a square configuration. The front face has a matrix of a first number of squares 18 each having a first surface area. Note FIG. 1. The rear face has a matrix of a second number of squares 19 greater than the first number. Further, the squares of the rear face of the game board each have a second surface area less than the first surface area. See FIG. 3.

Figure 2:
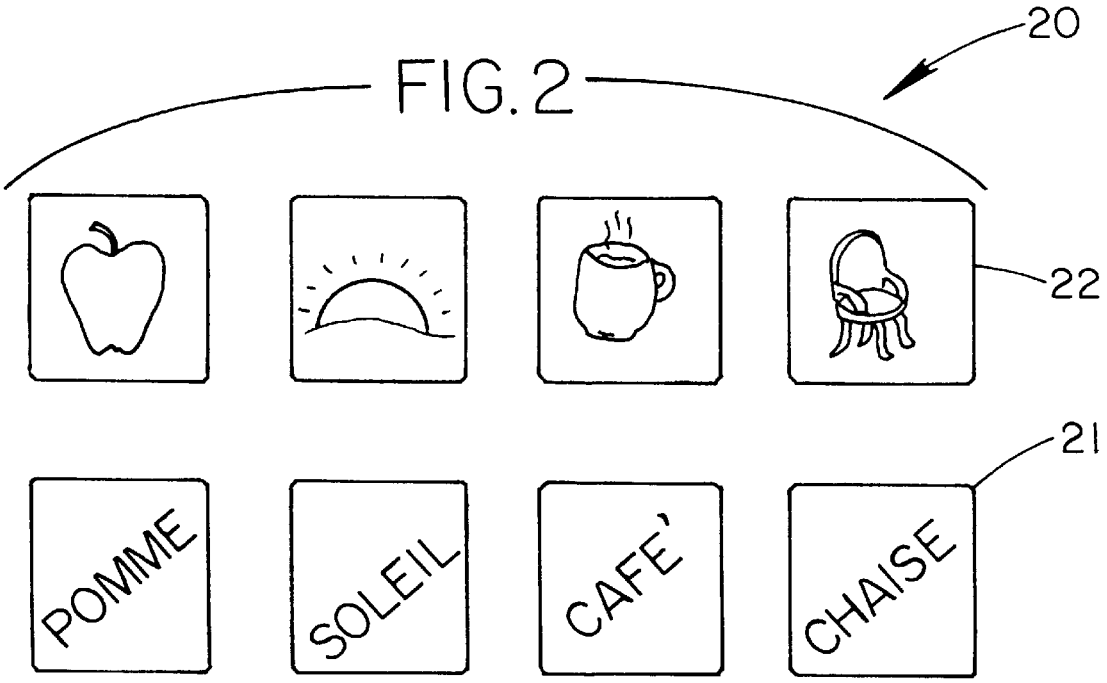
FIG. 2 is a top view of the first set of blocks of the present invention.

Next provided is a first set of blocks 20 each having a thin square configuration with a pair of faces each having the first surface area. The first set of blocks includes a first subset of blocks 21 having a written word of a foreign language representative of a unique object thereon. Associated therewith is a second subset of blocks 22 having a pictorial representation of one of the objects, as shown in FIG. 2.

FIG. 5 shows a second set of blocks 24 each having a thin square configuration with a pair of faces each having the second surface area. The blocks of the second set each have a first side face 26 having a letter printed thereon. A second side face 28 has a number printed thereon representative of a score value of the letter associated therewith. For reasons that will soon become apparent, each block of the second set of blocks has one of two colors.

The method associated with the present invention will now be set forth. A first game is played with the front face of the game board and the first set of blocks. Prior to play, each of the blocks is situated on the squares of the matrix. Next, each of a plurality of players takes turns with each turn comprising various steps. First, the current player picks up of one of the blocks of the first subset of blocks and one of the blocks of the second subset of blocks. It is imperative that the pictorial representation and the written word of the blocks correspond. If they do correspond, the current player is awarded a predetermined amount of points. This procedure is repeated until the current player picks up blocks with a wrong match at which time a subsequent player takes a turn. The present game ends when all matches have been made with the player having the most matches being declared as the winner.

Yet another associated game of the present invention requires use of the rear face of the game board and the second set of blocks. Such blocks of the second set are first distributed to each of a plurality of players prior to play. Each player organizes their blocks with a stand 30, as shown in FIG. 4.

The second game first requires the making of a first word in a first language on adjacent squares of the matrix of the rear face of the game board. The first word must be constructed from blocks of a first one of the colors. During the same turn, the current player is required to make a second word in a second language on adjacent squares of the matrix of the rear face of the game board. The blocks of the second word, however, must be constructed from blocks of a second one of the colors.

In the present game, the players are awarded a number of points corresponding to the number on each block of the first word. In addition, the current player is awarded a number of points corresponding to twice the number on each block of the second word. If any one of the words constructed in a turn are spelled wrong, the points associated with the blocks used during that turn are lost. Upon any player reaching a predetermined amount of points, he or she is awarded a blank block that can serve as any letter. At the end of the game, the total score of each player is totaled with the score of any unused blocks being subtracted from the total. It should be noted that any other details omitted regarding the method of the present invention resembles that of conventional SCRABBLE (trademark).

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved language game comprising, in combination:

a planar rigid game board having a front face, a rear face and a square configuration, the front face having a matrix of a first number of squares each having a first surface area, the rear face having a matrix of a second number of squares greater than the first number and each having a second surface area less than the first surface area;

a first set of blocks each having a thin square configuration with a pair of faces each having the first surface area, the first set of blocks including a first subset of blocks having a written word of a foreign language representative of a unique object thereon and a second subset of blocks having a pictorial representation of one of the objects; and a second set of blocks each having a thin square configuration with a pair of faces each having the second surface area, the second set of blocks each having a first side face having a letter printed thereon and a second side face having a number printed thereon representative of a score value of the letter associated therewith, wherein each block of the second set of blocks has one of two colors.

2. A language game comprising:

a game board having a front face, a rear face and a square configuration, the front face having a matrix of a first number of squares each having a first surface area; and a set of blocks each having a thin square configuration with a pair of faces each having the first surface area, the set of blocks including a first subset of blocks having a written word of a foreign language representative of a unique object thereon and a second subset of blocks having a pictorial representation of one of the objects thereon.

3. A language game as set forth in claim 2 wherein the rear face of the game board has a matrix of a second number of squares greater than the first number and each having a second surface area less than the first surface area and further included is a second set of blocks each having a thin square configuration with a pair of faces each having the second surface area, the second set of blocks each having a letter printed thereon and a number printed thereon representative of a score value of the letter associated therewith.

4. A language game as set forth in claim 3 wherein each block of the second set of blocks has one of two colors.

5. A method of playing a dual foreign language game comprising the steps of:

providing a planar rigid game board having a front face, a rear face and a square configuration, the front face having a matrix of a first number of squares each having a first surface area, the rear face having a matrix of a second number of squares greater than the first number and each having a second surface area less than the first surface area;

providing a first set of blocks each having a thin square configuration with a pair of faces each having the first surface area, the first set of blocks including a first subset of blocks having a written word of a foreign language representative of a unique object thereon and a second subset of blocks having a pictorial representation of one of the objects;

providing a second set of blocks each having a thin square configuration with a pair of faces each having the second surface area, the second set of blocks each having a first side face having a letter printed thereon and a second side face having a number printed thereon representative of a score value of the letter associated therewith, wherein each block of the second set of blocks has one of two colors;

playing a first game with the front face of the game board and the first set of blocks with each of the blocks situated on the square of the matrix, wherein each of a plurality of players takes turns with each turn comprising the steps of:

picking up of one of the blocks of the first subset of blocks and one of the blocks of the second subset of blocks such that the pictorial representation corresponds to the written word, awarding each player a predetermined amount of points for each pair of blocks picked up, and allowing each player to continue to picking up blocks until a wrong match is made at which time a subsequent player takes a turn; and playing a second game with the rear face of the game board and the second set of blocks with a plurality of the blocks of the second set being distributed to each of a plurality of players prior to play, wherein each of the plurality of players takes turns with each turn comprising the steps of:

making a first word in a first language on adjacent squares of the matrix of the rear face of the game board with the word being constructed from blocks of a first one of the colors, making a second word in a second language on adjacent squares of the matrix of the rear face of the game board with the word being constructed from blocks of a second one of the colors, awarding a number of points to the current player corresponding to the number on each block of the first word, and awarding a number of points to the current player corresponding to twice the number on each block of the second word.

* * * * *